US008554113B2

(12) United States Patent
Kidaka

(10) Patent No.: US 8,554,113 B2
(45) Date of Patent: Oct. 8, 2013

(54) IMAGE FORMING APPARATUS

(75) Inventor: Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 13/039,465

(22) Filed: Mar. 3, 2011

(65) Prior Publication Data

US 2011/0222898 A1 Sep. 15, 2011

(30) Foreign Application Priority Data

Mar. 9, 2010 (JP) ..... 2010-052018

(51) Int. Cl.
*G03G 15/02* (2006.01)

(52) U.S. Cl.
USPC ..... 399/170; 399/97

(58) Field of Classification Search
USPC ..... 399/97, 100, 170, 171
See application file for complete search history.

(56) References Cited

U.S. PATENT DOCUMENTS

2005/0105929 A1* 5/2005 Chae et al. ..... 399/69

FOREIGN PATENT DOCUMENTS

JP 2007-072212 A 3/2007
JP 2008145851 A * 6/2008

OTHER PUBLICATIONS

JP 2008145851 English Translation, Owaki et al., Jun. 2008.*
JP 2007072212 English Translation, Moriyama et al., Mar. 2007.*

* cited by examiner

*Primary Examiner* — David Gray
*Assistant Examiner* — Thomas Giampaolo, II
(74) *Attorney, Agent, or Firm* — Canon U.S.A., Inc. IP Division

(57) ABSTRACT

An image forming apparatus includes a corona charger having an opening, a shutter configured to open and close the opening of the corona charger, a humidity sensor configured to detect humidity, and a control unit configured to control the so that time from ending an image forming process to closing the opening using the shutter is reduced when the humidity detected by the humidity sensor increases.

24 Claims, 8 Drawing Sheets

IMAGE FORMING APPARATUS

BACKGROUND OF THE INVENTION

1. Field of the Invention

The present invention relates to an image forming apparatus such as a copying machine, a facsimile, or a printer, that includes a coroner charger having a shutter.

2. Description of the Related Art

Conventionally, an electrophotographic image forming apparatus forms an image by performing an electrophotographic process including charging, exposing, developing, and transferring processes. When the image forming apparatus performs the charging process, a corona charger disposed adjacent to a photosensitive member uniformly charges the photosensitive member to a potential of a predetermined polarity.

In such a charging process, the corona charger charges the photosensitive member by employing a corona discharge method, so that discharge products such as ozone ($O_3$) and nitrogen oxides ($NO_x$) are generated.

If the discharge product then becomes attached to the photosensitive member and absorbs moisture, surface resistance of the photosensitive member becomes low at a portion where the discharge product is attached. As a result, image deletion is generated, so that an electrostatic latent image according to image information cannot be accurately formed.

To solve such a problem, Japanese Patent Application Laid-Open No. 2007-072212 discusses a configuration in which a shutter closes an opening of the corona charger at the same time as the image forming apparatus shifts to a low power consumption mode.

However, the discharge product continues to be attached to the photosensitive member from when the image forming apparatus ends performing the image forming process (i.e., the photosensitive member stops rotating) to when the image forming apparatus shifts to the low power consumption mode. In other words, according to the configuration discussed in Japanese Patent Application Laid-Open No. 2007-072212, the discharge product becomes attached to the photosensitive member while the image forming apparatus shifts to the low power consumption mode. In such a configuration, if a long period of time is set between ending the image forming process and closing the opening with the shutter after shifting to the low power consumption mode, a large amount of discharge product becomes attached to the photosensitive member. Image deletion is thus generated due to moisture absorption. On the other hand, if a short period of time is set between ending the image forming process and closing the opening with the shutter after shifting to the low power consumption mode, a greater amount of time becomes necessary for opening and closing the shutter. As a result, productivity of the image forming apparatus decreases.

SUMMARY OF THE INVENTION

The present invention is directed to reducing generation of image deletion and suppressing decrease in productivity due to frequent opening and closing of the shutter. At least one embodiment of the present invention is directed to an image forming apparatus that includes a corona charger having an opening, a shutter configured to open and close the opening of the corona charger, a humidity sensor configured to detect humidity, and a control unit configured to control the so that time from ending an image forming process to closing the opening using the shutter is reduced when the humidity detected by the humidity sensor increases.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An image forming apparatus according to a first exemplary embodiment of the present invention will be described in the following sections. First, the configuration of the image forming apparatus will be described with reference to FIGS. 1A and 1B. The corona charger and the opening and closing mechanism of the shutter will follow. Opening and closing control of the charger shutter, and comparison between the productivity of the control performed according to the present exemplary embodiment with that of conventional control will then be described.

Figure 1A:
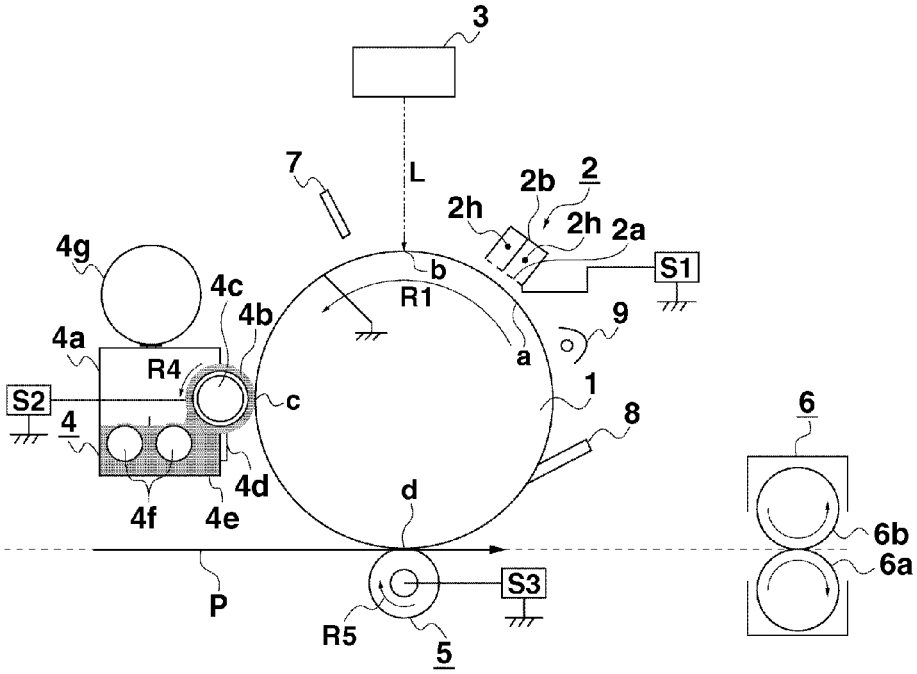
FIGS. 1A and 1B illustrate configurations of the image forming apparatus.
Figure 1B:
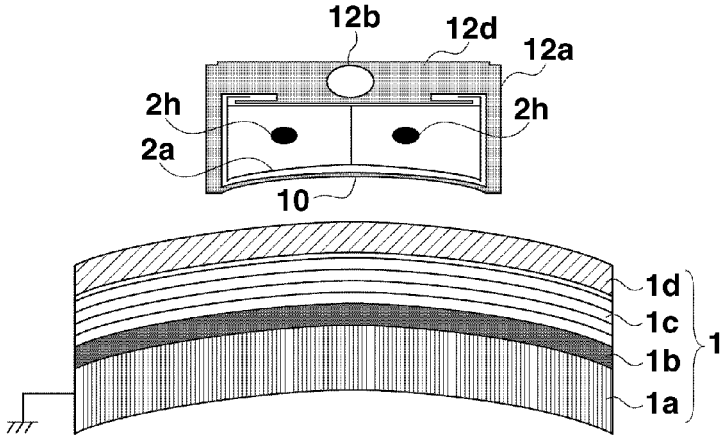

FIGS. 1A and 1B illustrate a configuration of the image forming apparatus. Referring to FIG. 1A, the image forming apparatus includes a photosensitive member 1 (i.e., an image bearing member) that is charged by the corona charger. A coroner charger 2, i.e., a charging device, an exposure device 3, a potential measuring device (i.e., a potential sensor) 7, a developing device 4, a transfer device 5, a cleaning device 8, and an optical neutralizing device 9 are disposed around the photosensitive member 1 in order along a rotational direction (indicated by an arrow R1 illustrated in FIG. 1A) of the photosensitive member 1. Further, a fixing device 6 is disposed downstream of the transferring device 5 with respect to a conveying direction of a sheet (i.e., a recording material P). Each of the image forming devices (i.e., image forming units) which performs the image forming process will be described below.

The photosensitive member 1, i.e., the image bearing member according to the present exemplary embodiment, is a cylindrical (drum-shaped) electrophotographic photosensitive member. An exemplary drum-shaped photosensitive member 1 has a diameter of 84 mm, and a length in the longitudinal direction of 380 mm. The photosensitive member 1 is rotatably driven, in the direction indicated by the arrow R1 illustrated in FIG. 1A, around the center of the drum at a process speed (peripheral speed) of 500 mm/sec, for example.

The photosensitive member 1 according to the present exemplary embodiment is formed of multiple layers as illustrated in FIG. 1B. Specifically, photosensitive member 1 includes a photosensitive layer that is an organic optical semiconductor having a charging characteristic of negative polarity. In addition, the photosensitive member 1 includes an aluminum cylinder 1*a*, i.e., a conductive base member, in an inner side in a radial direction of the drum (refer to lower portion of FIG. 1B). The three-layer structure is formed on the cylinder 1*a*. The three layers include an under coat layer 1*b* that reduces optical interference and improves adhesiveness of the upper layer, a charge generation layer 1*c*, and a charge transport layer 1*d*, that are layered in that order. The above-described photosensitive layer is formed of the charge generation layer 1*c* and the charge transport layer 1*d*.

The corona charger (i.e., a scorotron charger) which charges the photosensitive member (i.e., the member to be charged) will be described below. Referring to FIG. 1B, the charger 2 according to the present exemplary embodiment includes discharging wires 2*h*, a u-shaped conductive shield 2*b* disposed surrounding the discharging wires 2*h*, and a grid electrode 2*b* disposed in an opening portion of the shield 2*b*. The charger 2 includes two discharging wires 2*h* to realize high-speed image processing (increase the process speed), and the shield 2*b* is disposed to separate (i.e., build a wall between) the discharge wires 2*h*.

The corona charger 2 is disposed along a generatrix of the photosensitive member 1, so that the longitudinal direction of the corona charger 2 is parallel to an axial direction of the photosensitive member 1. Further, the grid 2*a* is disposed along the peripheral surface of the photosensitive member 1 as illustrated in FIG. 1B. The center of the grid 2*a* in the lateral direction is thus further away from the photosensitive member as compared to both edge portions of the grid 2*a* (i.e., convexed towards the discharge wire). The corona charger 2 can be placed adjacent to the photosensitive member 1 by employing such a configuration, and, as a result, charging efficiency can be improved.

Furthermore, the corona charger 2 is connected to a charging bias applying power source S1 that applies a charging bias. The corona charger 2 thus uniformly charges the surface of the photosensitive member to a potential of negative polarity at a charging position a, by the charging bias applied by the power source S1. More specifically, a charging bias of a direct current voltage is applied to the discharging wires 2*h* and the grid electrode 2*a*. Moreover, the charger includes a shutter 10 that opens and closes in a longitudinal direction of the corona charger to cover the opening of the corona charger (shield). A drive configuration of the shutter will be described in detail below.

The image forming devices (i.e., the image forming units) related to the image forming process including exposing, developing, and transferring processes will be described below. The exposure device 3 according to the present exemplary embodiment is a laser beam scanner including a semiconductor laser that irradiates (exposes) the photosensitive member 1 charged by the corona charger 2 with a laser beam L. More specifically, the exposure device 3 outputs the laser beam L based on an image signal transmitted from a host computer connected to the image forming apparatus via network cable (external interface). The laser beam L scans the charged surface of the photosensitive member 1 along a main scanning direction at an exposure position b. The exposure device 3 repeatedly performs the exposing process along the main scanning direction while the photosensitive member is rotating in the direction of arrow R1. The potential is thus reduced in the portion of the charged surface of the photosensitive member 1 that is irradiated with the laser beam L, so that the electrostatic latent image corresponding to the image information is formed. The main scanning direction is a direction that is parallel to the generatrix of the photosensitive member 1, and a sub-scanning direction is parallel to the rotational direction of the photosensitive member 1.

The developing device 4 according to the present exemplary embodiment attaches a developer (toner) to the photosensitive member 1 and thus visualizes the electrostatic latent image formed on the photosensitive member 1 by the charger 2 and the exposure device 3. The developing device 4 employs a two-component magnetic brush developing method and an inverse developing method. The developing device 4 includes a developer container 4*a*, a developing sleeve 4*b*, a magnet 4*c*, a developing blade 4*d*, a developer agitating member 4*f*, and a toner hopper 4*g*. A two-component developer 4*e* is contained in the developer container 4*a*.

The developing sleeve 4*b* is a non-magnetic cylindrical member and is rotatably-disposed on the developing container 4*a* exposing a portion of an outer peripheral surface to the outside. The magnet 4*c* is fixedly-disposed inside the developing sleeve 4*b* in a non-rotatable state. The developing blade 4*d* regulates a layer thickness of the two-component developer 4*e* coated on the surface of the developing sleeve. The developer agitating member 4*f* is placed on a bottom portion inside the developer container 4*a*. The developer agitating member 4*f* agitates and conveys towards the developing sleeve 4*b* the two-component developer 4*e*. The toner hopper 4*g* contains replenishing toner for replenishing the developer container 4*a*. Further, the two-component developer 4*e* inside the developer container 4*a* is a mixture of the toner and a magnetic carrier and is agitated by the developer agitating member 4*f*. An exemplary resistance of the magnetic carrier is 1013 Ohms-cm and a particle diameter is 40 μm. The toner is frictionally charged to a negative polarity by rubbing with the magnetic carrier.

The developing sleeve 4*b* is disposed facing the photosensitive member 1 so that the shortest distance from the photosensitive member 1 becomes 350 μm. The portions of the photosensitive member 1 and the developing sleeve 4*a* facing each other form a developing portion c. The surface of the developing sleeve 4*b* is rotatably driven in a developing portion c in a direction that is opposite to a moving direction of the surface of the photosensitive member 1. In other words, the surface of the developing sleeve 4*b* is rotatably driven in a direction indicated by an arrow R4 illustrated in FIG. 1B against the rotational direction of the photosensitive member 1 indicated by the arrow R1 illustrated in FIG. 1B.

A portion of the two-component developer 4*e* inside the developer container 4*a* is held as the magnetic brush layer on the outer peripheral surface of the developing sleeve 4*b* by a magnetic force of the magnet 4*c* inside the developing sleeve 4*b*. The magnetic brush layer is conveyed to the developing portion c along with the rotation of the developing sleeve 4*b*. The magnetic brush layer is then cut by the developing blade 4*d* to a predetermined thin layer and comes into contact with the photosensitive member 1 in the developing portion c. Further, the developing sleeve 4*b* is connected to a developing bias applying power source S2, and the toner in the developer carried on the surface of the developing sleeve 4*b* becomes selectively attached corresponding to the electrostatic latent image on the photosensitive member 1. The toner becomes attached by the electric field generated by the developing bias applied by the applying power source S2. As a result, the electrostatic latent image is developed to a toner image. According to the present exemplary embodiment, the toner is attached to the exposed portion (i.e., portion irradiated with the laser beam) on the photosensitive member 1, so that the electrostatic latent image is inversely developed. To that end, an exemplary charge amount of the toner developed on the photosensitive member 1 is 25 μC/g.

The developer on the developing sleeve 4*b* which passed through the developing portion c is collected in the developer container 4*a* along with the subsequent rotation of the developing sleeve 4*b*. Further, an optical toner density sensor (not shown) is disposed inside the developer container 4*a* to maintain the toner density of the two-component developer 4*e* in the developer container 4*a* within an approximately constant range. The toner hopper 4*g* replenishes the developer container 4*a* with an amount of toner corresponding to the toner density detected by the toner density sensor.

The transfer device 5 according to the present exemplary embodiment includes a cylindrical transfer roller as illustrated in FIG. 1A. The transfer device 5 is in press-contact with the surface of the photosensitive member 1 at a predetermined pressing force, and a press-contact nip portion becomes a transfer portion d. The recording material P (e.g., a paper or a transparent film) is fed from a sheet feed cassette to the transfer portion d at predetermined control timing. The toner image on the photosensitive member 1 is then transferred to the recording material P while the recording material P fed to the transfer portion d is conveyed being held between the photosensitive member 1 and the transfer roller of the transfer device 5. In such a case, a transfer bias applying power source S3 applies to the transfer roller a transfer bias (e.g., +2000 V according to the present exemplary embodiment) of a polarity that is opposite to the normal charge polarity (negative polarity) of the toner.

The fixing device 6 according to the present exemplary embodiment includes a fixing roller 6*a* and a pressing roller 6*b* as illustrated in FIG. 1A. The recording material P on which the toner image has been transferred by the transfer device 5 is conveyed to the fixing device 6. The recording material P is then heat-pressed by the fixing roller 6*a* and the pressing roller 6*b*, so that the toner image is fixed on the surface of the recording material P. The recording material P is then discharged outside the image forming apparatus.

The cleaning device 8 according to the present exemplary embodiment includes a cleaning blade as illustrated in FIG. 1A. After the transfer device 5 transfers the toner image on the recording material P, the cleaning blade of the cleaning device 8 removes residual toner remaining on the surface of the photosensitive member 1. The optical neutralizing device 9 according to the present exemplary embodiment includes a neutralizing light exposure lamp. The neutralizing light exposure lamp of the optical neutralizing device 9 performs exposure to neutralize the charge remaining on the surface of the photosensitive member 1 that has been cleaned by the cleaning device 8.

After the series of image forming processes has been performed by the above-described image forming units (devices), the image forming apparatus prepares for the subsequent image forming operation. The image forming process ends when the corona charger ends charging of the photosensitive member 1, the exposing device 3 ends exposing of the image, or the photosensitive member stops rotating.

The above-described image forming apparatus forms an image on the recording material (e.g., paper) according to an input print job (i.e., an image forming signal). After forming the image, the image forming apparatus shifts to a standby mode. The image forming apparatus regulates a standby temperature of the fixing device in the standby mode to be lower than a fixing temperature so that the time required to start the image forming process when the next print job is input becomes comparatively short. According to the present exemplary embodiment, the image forming apparatus is in the standby mode while a predetermined time (approximately three minutes) elapses after ending the image forming process. In other words, the image forming apparatus shifts from the standby mode to the low power consumption mode approximately after three minutes has elapsed from when the image forming process has ended. Here, the three minutes period is exemplary and can be changed accordingly.

The low power consumption mode is a mode in which the power consumption is lower than in the standby mode. More specifically, the low power consumption mode is a mode in which power consumption is reduced by stopping the power supply to the fixing device 6 that consumes a large amount of power. The temperature of the fixing device 6 in the low power consumption mode is not regulated to be at the standby temperature as in the standby mode. Time from when a job is input to outputting a printed product (i.e., first copy out time (FCOT)) thus becomes longer in the low power consumption mode as compared to the standby mode. According to the present exemplary embodiment, time for closing the opening using the charger shutter to be described below, and time for shifting from the standby mode to the low power consumption mode (i.e., time of the standby mode) are different. In other words, the time from the end of the image forming process to closing the opening with the shutter (i.e., time while the shutter is kept open) and the time in which the image forming apparatus is in the standby mode can be independently set.

The charging device according to the present exemplary embodiment will be described in detail below with reference to FIGS. 2, 3A, 3B, and 3C.

Figure 2:
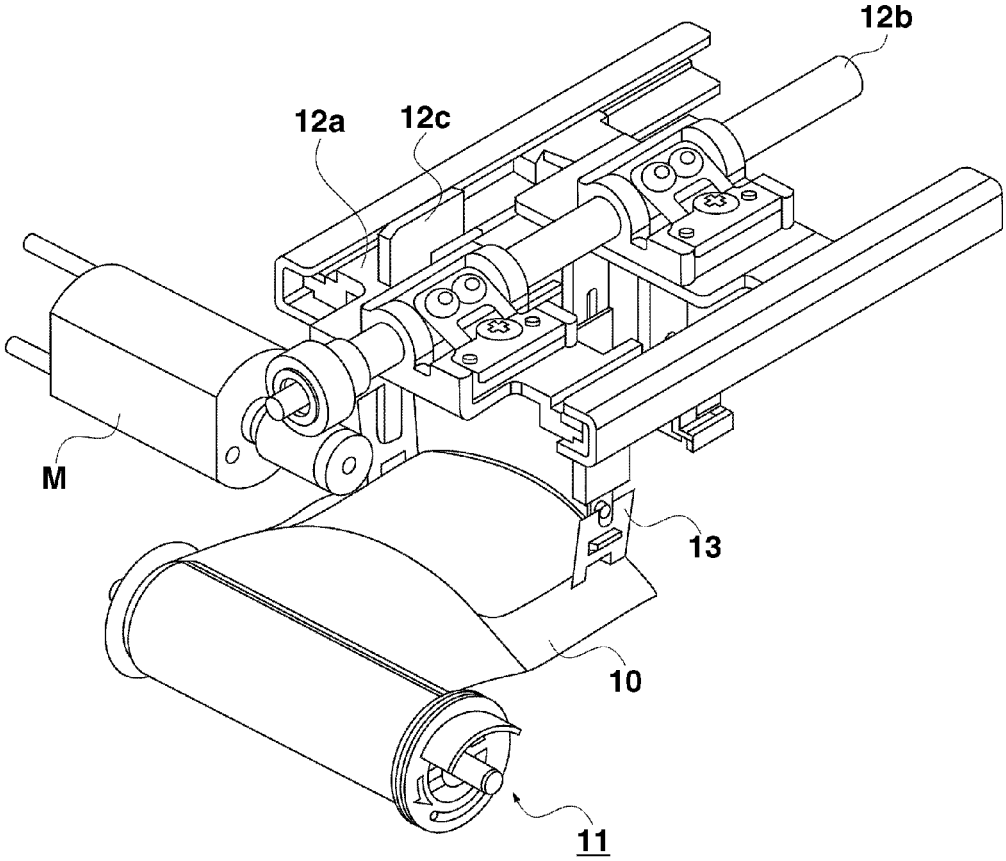
FIG. 2 illustrates an opening and closing mechanism of a charger shutter.

Referring to FIG. 2, the charging device according to the present exemplary embodiment includes a charger shutter 10 that opens and closes the opening of the corona charger in the longitudinal direction. If the corona charger is disposed adjacent to the photosensitive member (at a distance of approximately 1 mm) to improve the charging efficiency thereof, it becomes necessary to move the shutter within a small gap (refer to FIG. 1B). The charger shutter 10 is thus formed of a soft nonwoven sheet of material that does not scratch the photosensitive member even when coming into contact with the photosensitive member. More specifically, a polyimide nonwoven sheet having a thickness of about 30 μm may be used as the charger shutter 10.

The shutter which opens and closes the opening of the corona charger in the longitudinal direction is wound up by a winding device 11. Further, a plate spring 13 which is a regulating member that regulates the sheet to be in a convex shape is disposed on a leading edge with respect to a closing direction of the shutter. The plate spring 13 is disposed so as to prevent a center portion of the charger shutter 10 in the opening of the corona charger from drooping and coming into contact with the photosensitive member 1. Furthermore, a guide member (not illustrated) is disposed on the winding device 11 so that the shutter becomes convex shaped in a direction of the corona charger. The soft shutter is thus constructed so that it does not easily droop. Moreover, a coil spring (not shown) is included in the winding device 11 to bias the shutter towards a winding direction. The coil spring applies a force that spreads the charging shutter in the longitudinal direction of the opening to prevent the sheet-shaped shutter from drooping.

As a result, the center portion in the short length direction (i.e., the moving direction of the photosensitive member) of the charger shutter 10 protrudes and is stretched towards the corona charger 2 as compared to both ends of the charger shutter 10. The gap between the corona charger 2 and the photosensitive member 1 can thus be minimized. According to the present exemplary embodiment, a curvature of the charger shutter 10 which is previously formed in a particular manner matches the peripheral surface of the photosensitive member 1. If the curvatures of the charger 2 (grid electrode) and the photosensitive member 1 are different, it is desirable to set the curvature of the charger shutter to be greater than or equal to at least one of the curvatures.

The shutter opening and closing mechanism in which the carriage 12*a*, i.e., a moving member that supports the leading edge of the charging shutter, is moved in the opening direction of the corona charger will be described below with reference to FIGS. 2, 3A, 3B, and 3C.

Figure 3A:
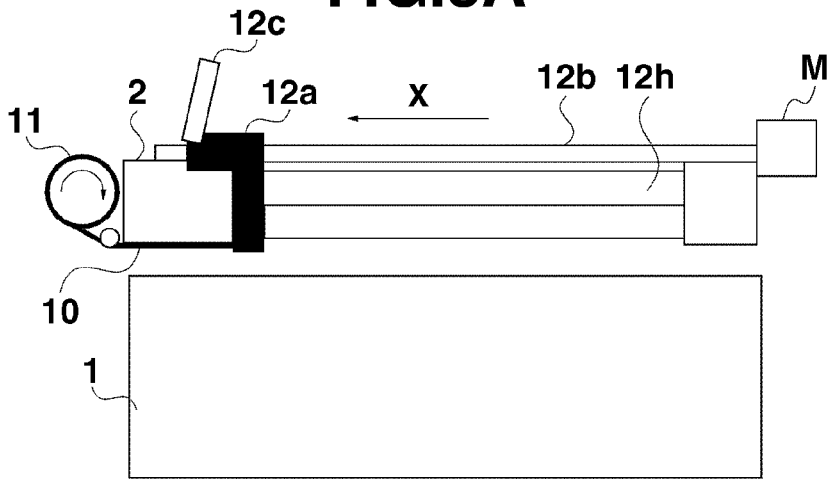
FIGS. 3A, 3B, and 3C illustrate open and closed states of the charger shutter.
Figure 3B:
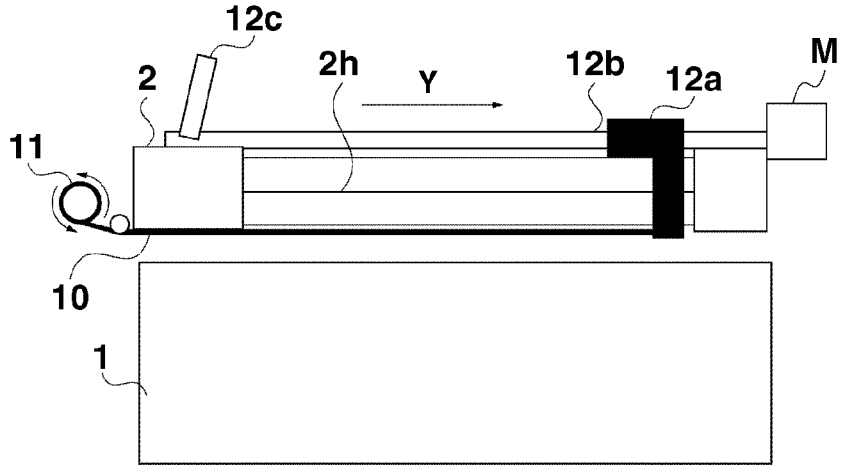

Referring to FIG. 2, the plate spring 13, i.e., the regulating member that regulates the shape of the charging shutter 10, is connected to the carriage 12*a*, i.e., the moving member. The charging shutter thus moves in an opening direction along with the movement of the carriage. The opening and closing mechanism for moving the charging shutter includes a driving motor M, the moving member 12*a*, a screw, i.e., a rotating member 12*b*, a connecting member 12*d*, and the winding device 11. Referring to FIGS. 3A and 3B, the screw, i.e., the rotating member 12*b*, on which a spiral groove is formed, is connected to the driving motor M. When the rotating member 12*b* is rotatably driven by the driving motor M, the connecting member 12*d* threadably mounted on the rotating member 12*b* moves in the main scanning direction (i.e. X and Y directions) along the spiral groove. The connecting member 12*d* is threadably mounted to be capable of moving only in the main scanning direction on a rail set on the shield 2*b* to prevent the connecting member 12*d* from rotating together with the rotating member 12*b*. As a result, when the rotating member 12*b* is driven by the driving motor M, a moving force in the opening and closing direction is transmitted to the charger shutter 10 via the moving member 12*a* integrated with the connecting member 12*d*.

A shutter detection device 12*c* detects that the charger shutter has completed an opening operation. The shutter detection device 12*c* includes a photointerrupter. When the moving member 12*a* reaches an opening operation completion position, the photointerrupter detects that the charger shutter 10 has completed the opening operation by the moving member 12*a* blocking the light from entering the photointerrupter. In other words, the rotation of the driving motor M is stopped when the shutter detection device 12*c* detects the moving member 12*a*.

The operation in which the charging shutter opening and closing mechanism causes the charging shutter to open and close the opening of the corona charger will be described below with reference to FIGS. 3A, 3B, and 3C.

FIG. 3A illustrates a state in which the sheet-shaped charger shutter 10 is opened when it is wound to move in the X direction. According to the present exemplary embodiment, the charger shutter 10 that opens and closes the opening of the corona charger 2 is a sheet-shaped shutter that can be wound into a roll shape by the winding device 11.

FIG. 3B illustrates a state in which the sheet-shaped charger shutter 10 is closed being drawn out to move in the Y direction. As described above, since the winding roller 11 biases the charging shutter 10 in the winding direction, tensile force is applied on the sheet, so that the sheet is prevented from drooping in a direction of gravitational force. FIGS. 3A and 3B illustrate the open and closed states of the charger shutter 10 according to the present exemplary embodiment. FIG. 3C illustrates an example in which the winding direction is inversed.

Figure 3C:
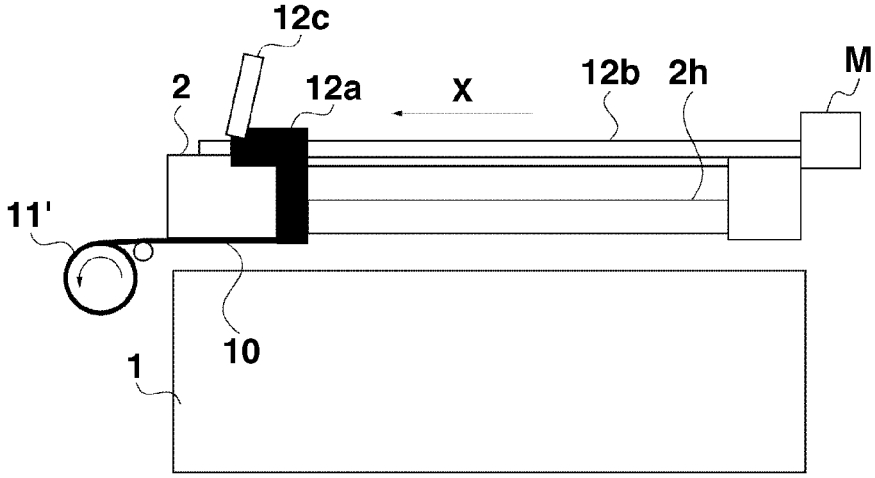

Referring to FIG. 3C, when the sheet-shaped shutter is wound up, there is an advantage that the shutter is formed in a particular manner so that the shutter does not come into contact with the photosensitive member. However, if the corona charger includes a grid, the pressure on the shutter and the grid increases, so that it is desirable to use a shutter of high abrasion resistance.

A hardware block diagram illustrating a control circuit that controls the image forming apparatus will be described below with reference to FIGS. 4A and 4B. Further, flowcharts illustrating opening and closing control of the charging shutter will be described below with reference to FIGS. 5 and 6. Furthermore, a comparison between productivities of a conventional control method and the control according to the present exemplary embodiment will then be described below with reference to FIG. 7.

Figure 4A:
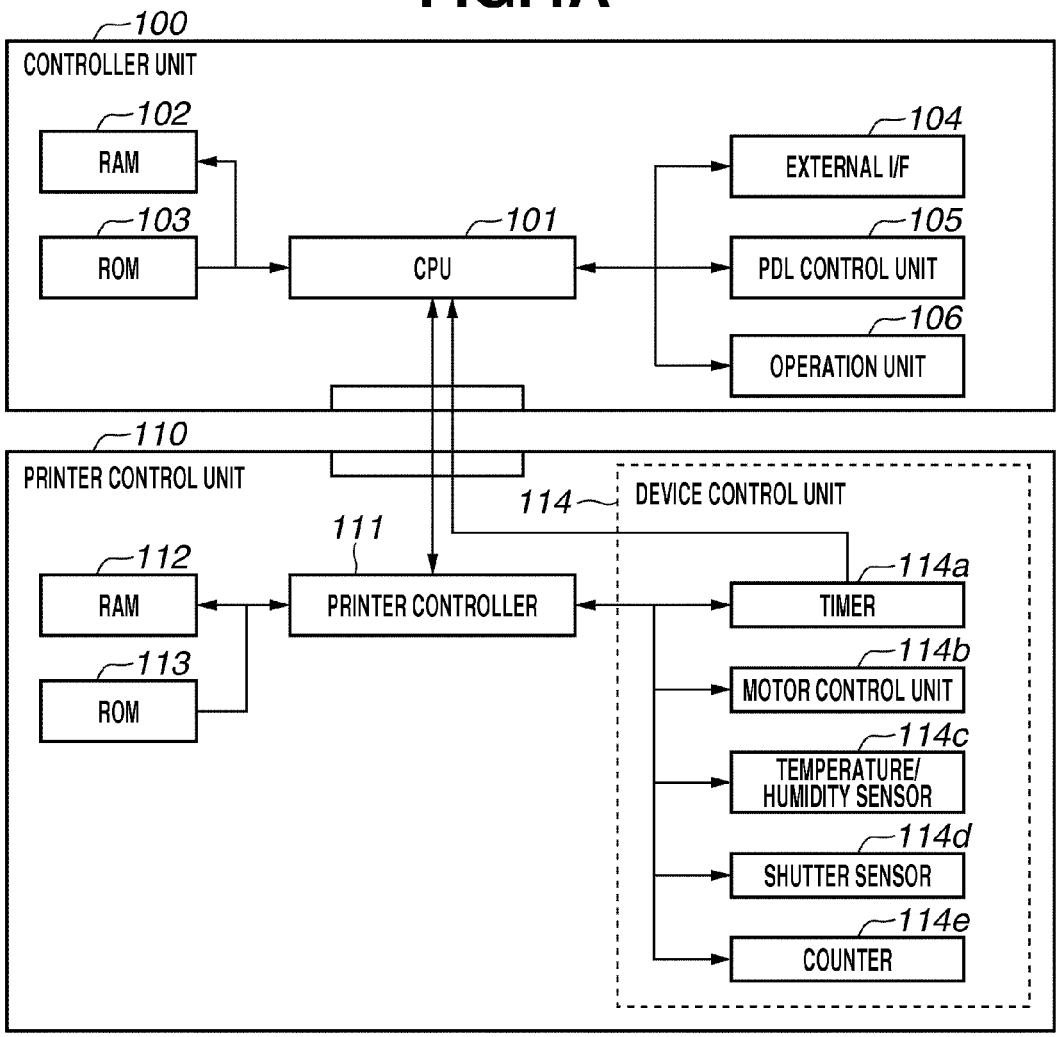
FIGS. 4A and 4B are block diagram illustrating a control circuit and a schematic diagram illustrating an operation unit of an image forming apparatus.

FIG. 4A is a hardware block diagram illustrating a central processing unit (CPU), i.e., a control unit for controlling the image forming apparatus, and connection relationship between each of the components. Referring to FIG. 4A, the image forming apparatus 1 is controlled by a controller unit 100 that performs job management, and a printer control unit 110 that controls a printer unit to form the image data on the sheet as a visualized image.

The controller unit 100 includes a CPU 101, a read only memory (ROM) 103 in which control programs are stored, and a random access memory (RAM) 102 that store data for performing the processes. Further, a bus connects such components so that the components can exchange information (communicate) with each other.

The CPU 101 includes an external interface (I/F) 104 for communicating with the outside, and a page description language (PDL) control unit 105 for processing, storing, and performing image processing on received data. The CPU 101 is connected to the printer control unit 110 via an internal interface (I/F).

Figure 4B:
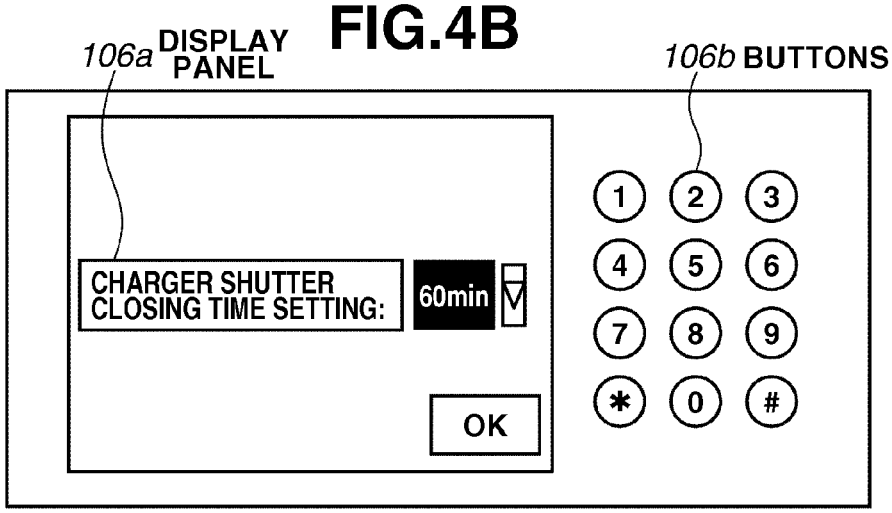

Further, the CPU 101 is connected to an operation unit 106 as illustrated in FIG. 4B. Referring to FIG. 4B, the operation unit 106 includes a display panel 106*a*, i.e., a display unit, and buttons 106*b* for receiving input from a user. The CPU 101 thus displays to the user on the display panel 106*a*, an apparatus status and a selected mode, and can acquire information input by the user using the buttons 106*b*.

The printer control unit 110 controls the printer unit (i.e., each of the image forming units) and performs basic control of the image forming process. The printer control unit 110 includes a printer controller 111, a ROM 113 that stores the control programs, and a RAM 112 that stores data for performing the image forming process. Such components are connected and can communicate with each other via a bus (represented by connecting arrows in FIG. 4A). The ROM 113 stores the programs for executing control procedures illustrated in FIGS. 5 and 6 to be described below. The device control unit 114 is an electric circuit including an input/output port for controlling each component in the printer unit.

The device control unit 114 includes a timer 114*a*, i.e., a time measuring unit for measuring the time, and a motor control unit 114*b* that controls a motor which moves a shielding member (i.e., the charging shutter) for shielding the drum. Further, the device control unit 114 includes a temperature/ humidity sensor 114*c* that measures the temperature and the humidity. Furthermore, the device control unit 114 includes a shutter sensor 114*d* that detects a position of the shielding member, and a counter 114*e*, i.e., a history storing unit, that counts a number of sheets (accumulated number of sheets) on which the image forming apparatus has formed the images.

The timer 114*a* includes a separate power source such as a battery. The timer 114*a* can thus restore the CPU 101 from a stop state by transmitting a signal to the CPU 101 in the stop state after a predetermined time has elapsed. Further, the timer 114*a* can store the time that has elapsed from when the image forming process has ended (i.e., from when the photosensitive drum has stopped according to the present exemplary embodiment). The printer controller 111 can calculate moisture content in the atmosphere from a detection result of the temperature/humidity sensor 114*c* that detects the temperature and the humidity of an installation environment of the image forming apparatus. Since generation of image deletion greatly depends on the humidity, the opening and closing control of the charging shutter can be performed by using the humidity of the installation environment of the image forming apparatus instead of the moisture content.

Figure 5:
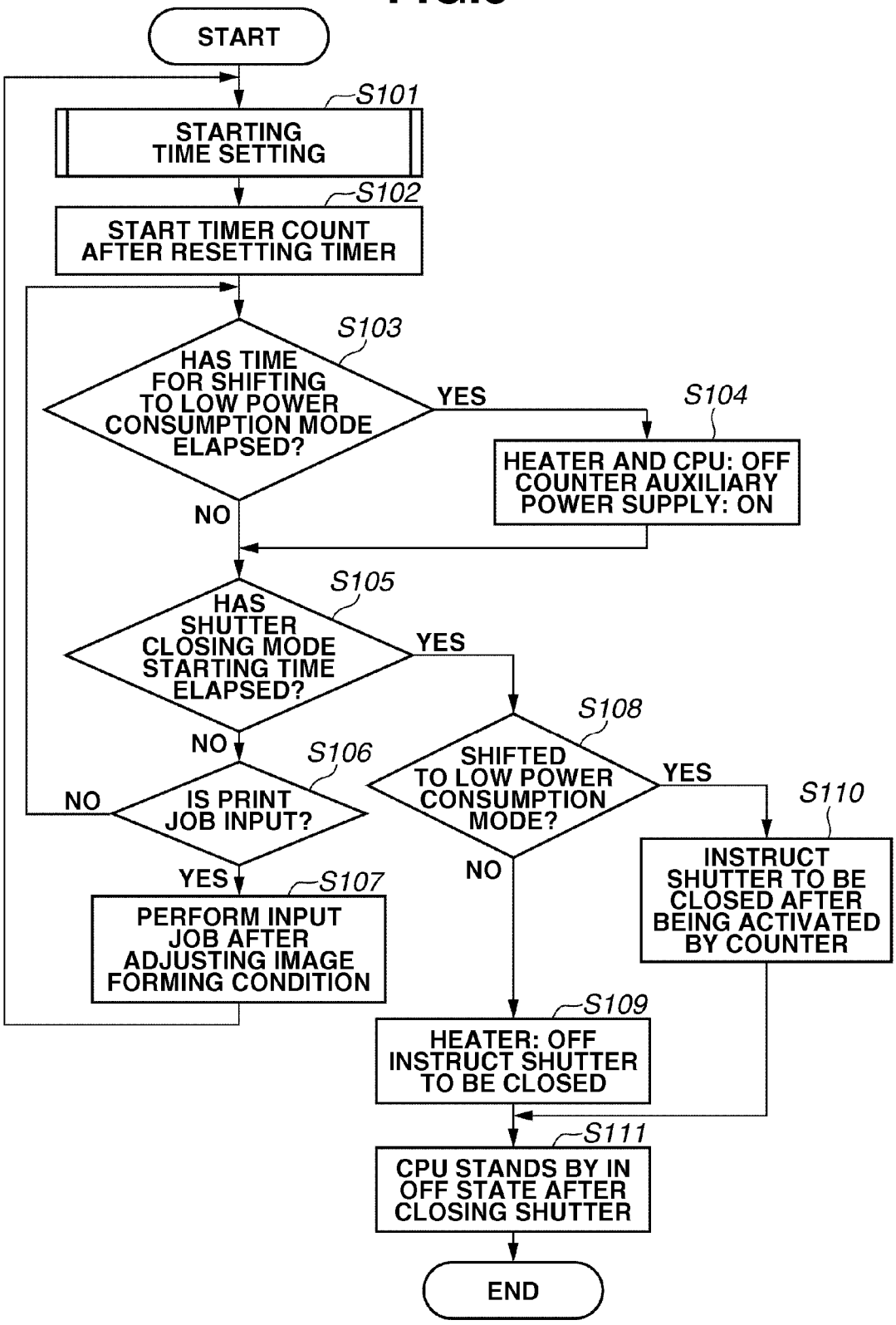
FIG. 5 is a flowchart illustrating opening and closing control of the charger shutter.

FIG. 5 is a flowchart illustrating switching between the standby mode and the low power consumption mode, and opening and closing of the shutter. A defined process (step S101) illustrated in FIG. 5 will be described in detail below with reference to the flowchart illustrated in FIG. 6. As described above, according to the present exemplary embodiment, the end of the image forming process may be when the corona charger ends charging the photosensitive member, when the exposing device ends exposing the image, or when the photosensitive member stops rotating.

The CPU 101, i.e., the control unit, controls each component in the image forming apparatus as described below according to the program stored in the ROM 102. A start time setting (i.e., step S101) for setting a start time from the end of the image forming process to closing the shutter (i.e., time to starting to close the shutter) will be described below with reference to FIG. 6.

The control performed by the CPU 101 in each of the steps will be described with reference to FIG. 5.

In step S101, the time between the end of the image forming process (i.e., when the photosensitive member stops rotating) to closing the shutter is determined based on the moisture content in the installation environment of the image forming apparatus. The CPU 101, i.e., the control unit, calculates the moisture content of the installation environment from the temperature and the humidity acquired by the temperature/humidity sensor, and determines the start time based on the moisture content.

In step S102, the CPU 101 acquires the time from the end of the image forming process. The CPU 101 causes the timer 114*a* to start measuring the time. If the image forming process according to the input print job (i.e., a series of image forming commands) has ended (i.e., after performing step S108), the CPU 101 causes the timer 114*a* to measure (count) the time after initializing (resetting) the timer 114*a*.

In step S103, the CPU 101 shifts the image forming apparatus from the standby mode to the low power consumption mode, separately from opening and closing the shutter. The CPU 101 switches between continuing the standby mode and shifting to the low power consumption mode, according to whether a predetermined time (e.g., three minutes) has elapsed. If the predetermined time (three minutes) has elapsed after the image forming process has ended (YES in step S103), the process proceeds to step S104. If the predetermined time (three minutes) has not elapsed (NO in step S103), the process proceeds to step S105. Alternatively, even if the predetermined time has not elapsed, if the user presses a button (not illustrated) on the image forming apparatus for shifting to the low power consumption mode, the image forming apparatus shifts to the low power consumption mode (i.e., the process proceeds to step S104).

In step S104, the CPU 101 reduces the power supplied to each component in the image forming apparatus in the low power consumption mode so that the power consumed by the image forming apparatus becomes low. The CPU 101, i.e., the control unit, instructs the printer controller 111 to reduce the power to be supplied to the printer unit. More specifically, the printer controller 111 stops supplying power to the fixing device 6 on which temperature control is performed to be the standby temperature (120° C.) in the standby mode. Further, the printer controller 111 supplies power to only the timer 114*a* and the external I/F (i.e., switches to a battery operation using an internal battery). The image forming apparatus is in the low power consumption mode if the consumed power is less than the standby mode.

In step S105, the image forming apparatus shifts to a shutter closing mode when the time elapsing from the end of the image forming process has reached the time set in step S101. If the start time set in step S101 has elapsed from the end of the image forming process (YES in step S105), the process proceeds to step S108. If the elapsed time has not reached the start time (NO in step S105), the process proceeds to step S106.

In step S106, the CPU 101 determines whether to perform the image forming process when the print job (i.e., the series of image forming commands) has been input in the standby mode or the low power consumption mode. If the print job is input from the external I/F (YES in step S106), the process proceeds to step S107. If the print job is not input (NO in step S106), the process returns to step S103, and the CPU 101 continues the standby mode or the low power consumption mode.

In step S107, the CPU 101 outputs the image corresponding to the print job. The CPU 101 processes the input print job using the PDL control unit, transfers the processed result to the printer controller 111, and outputs the image.

In step S108, the CPU 101 determines whether the image forming apparatus has shifted to the low power consumption mode. If the image forming apparatus has shifted to the low power consumption mode (YES in step S108), the process proceeds to step S110. If the image forming apparatus has not shifted to the low power consumption mode (NO in step S108), the process proceeds to step S109.

In step S109, i.e., the step performed when the start time has elapsed before shifting to the low power consumption mode, the CPU 101 instructs the motor control unit 114*b* to close the charging shutter. The CPU 101 also stops supplying power to the fixing device 6.

In step S110, i.e., the step performed when the start time has elapsed after shifting to the low power consumption mode, the counter 114*a* restores the CPU 101 from the stop state. The restored CPU 101 then instructs the motor control unit 114*b* to close the charging shutter.

In step S111, the CPU 101 responds to the input print job after detecting that the shutter is closed. After the shutter sensor 114*d* detects that the charging shutter has been closed, the CPU 101 stops supplying power to the components other than the external I/F to respond to the print job, and shifts to the stop state. The stop state indicates a state in which the power is stopped from being supplied to each component so that the standby power becomes proximately 0 W.

Figure 6:
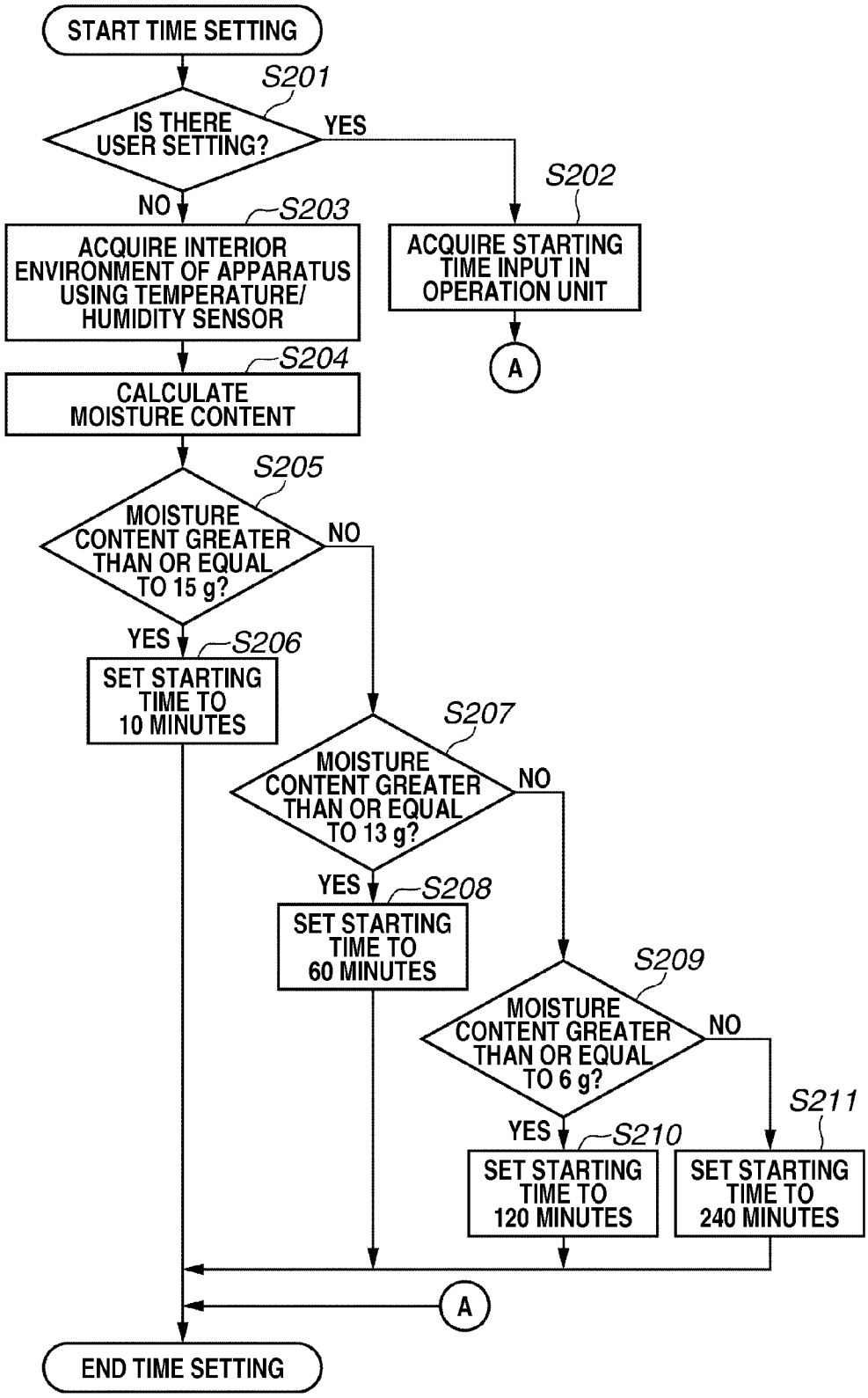
FIG. 6 is a flowchart illustrating opening and closing control of the charger shutter.

The start time setting (step S101), i.e., the defined process, will be described in detail below with reference to FIG. 6. In the process, the time until closing the shutter is changed based on the moisture content calculated from the temperature and the humidity of the installation environment of the image forming apparatus.

In step S201, the CPU 101 checks whether the user (or a service personnel) has set the time from the end of the image forming process to closing the charging shutter. If a charging shutter closing time is previously set by the user operating on the operation unit illustrated in FIG. 4B (YES in step S201), the process proceeds to step S202. In step S202, the CPU 101 specifies a setting so that the shutter is closed at the set time, and the process ends.

In step S203 to step S211, the CPU 101 sets, when the time until closing the charging shutter has not yet been set, the time until closing the charging shutter based on the moisture content. In step S203, the CPU 101 acquires from the temperature/humidity sensor (temperature sensor and humidity sensor) 114*c*, i.e., an environment sensor, the temperature and the humidity of the installation environment of the image forming apparatus. In step S204, the CPU 101, i.e., a calculation unit, calculates the moisture content in the atmosphere, using the result acquired by the temperature/humidity sensor, i.e., the environment sensor.

The CPU 101, i.e., a determination unit for determining the time until closing the charging shutter, then changes the setting time of the timer 114*a*, based on the moisture content acquired in step S204. The moisture content and the value of the setting time are an example and may be other values.

In step S205, if the moisture content is greater than or equal to 15 g (YES in step S205), the process proceeds to step S206. In step S206, the CPU 101 sets the time for closing the charging shutter on the timer 114*a* to 10 minutes.

In step S207, if the moisture content is less than 15 g and greater than or equal to 13 g (YES in step S207), the process proceeds to step S208. In step 208, the CPU 101 sets the time for closing the charging shutter on the timer 114*a* to 60 minutes.

In step S209, if the moisture content is less than 13 g and greater than or equal to 6 g (YES in step S209), the process proceeds to step S210. In step 210, the CPU 101 sets the time for closing the charging shutter on the timer 114*a* to 120 minutes.

In step S211, if the moisture content is less than 6 g, the CPU 101 sets the time for closing the charging shutter on the timer 114*a* to 240 minutes.

As a result, the CPU 101, i.e., the control unit, can set the desirable shutter closing time according to the temperature and the humidity of the installation environment of the image forming apparatus.

As described above, if the moisture content in the copying machine is small when the print job ends, so that the image deletion is not easily generated, the time between ending the print job to starting to close the charging shutter is set long. Durability of the shutter and the driving device is thus increased, and a decrease in the productivity due to the time necessary for restoring from the closed state to the open state after once closing the shutter can be reduced.

Further, if the moisture content in the copying machine is large when the print job ends and image deletion may be easily generated, the time between ending the print job to starting to close the charging shutter is set short. The generation of image deletion and lowering of productivity can thus be reduced.

A comparison between the productivities of the image forming apparatus in two cases will be described below. Namely, a first case is where the charging shutter is closed every time the image forming apparatus shifts to the low power consumption mode. A second case is where the time from ending the image forming process to starting to close the charging shutter (shutter close control time) is independently set from the time for shifting to the low power consumption mode.

Figure 7A:
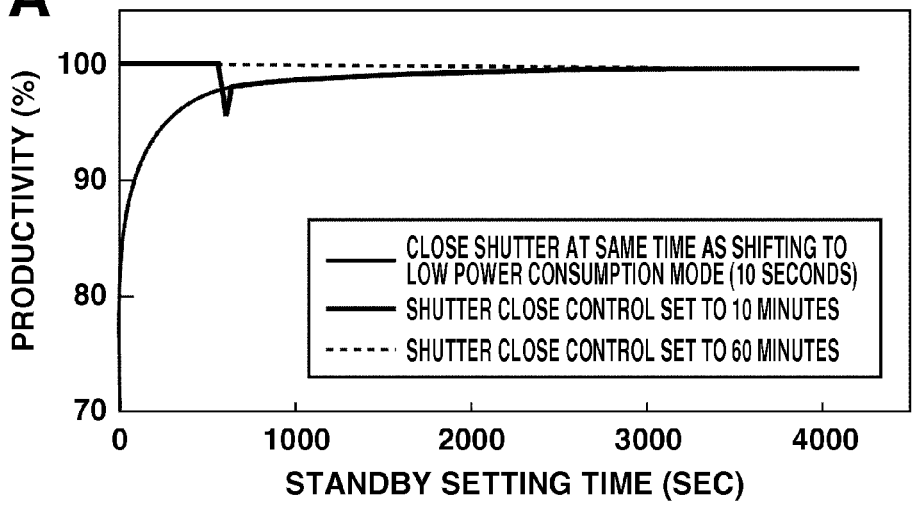
FIGS. 7A, 7B, and 7C are graphs for comparing productivities of control performed according to an exemplary embodiment of the present invention and a conventional control.
Figure 7B:
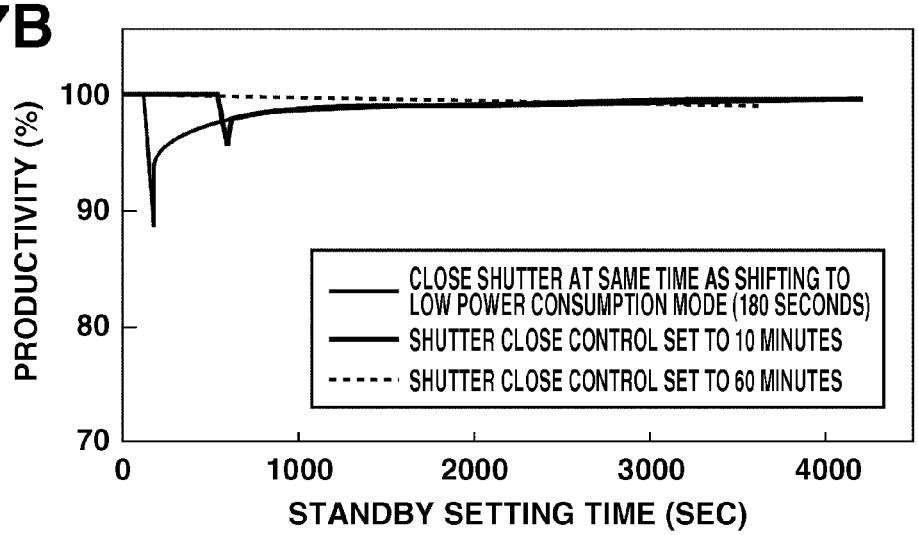
Figure 7C:
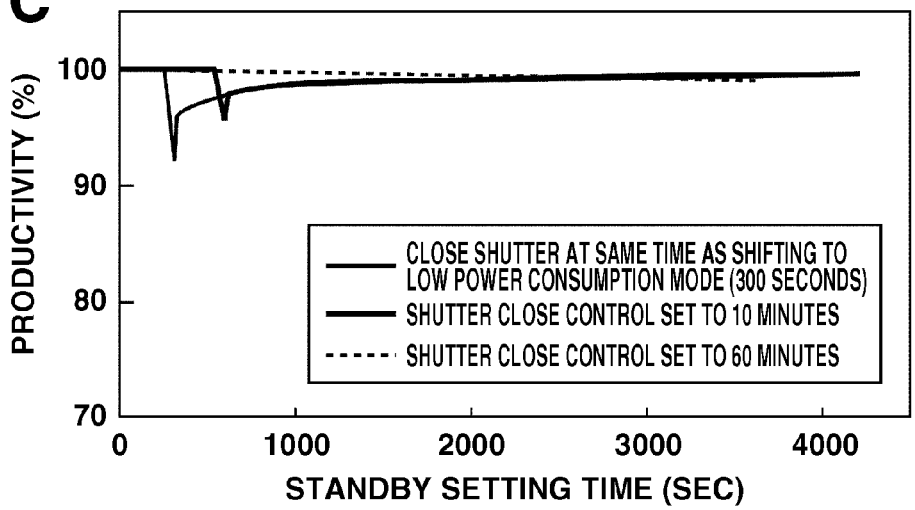

FIGS. 7A, 7B, and 7C are graphs illustrating a change in the productivities under each condition. The vertical axis indicates a percentage of the number of sheets on which images are formed under each condition in a case where the number of sheets having formed images is set as 100% when the charging shutter is not closed. The horizontal axis indicates a standby time until starting the next job for every 100 sheets.

Each condition (setting) will be described below. Time to shifting to the low power consumption mode is set as 10 seconds (FIG. 7A), 180 seconds (FIG. 7B), and 300 seconds (FIG. 7C) respectively. Under such condition, images are continuously output to 100 sheets of A4 size paper, and the standby time until starting the next job for every 100 sheets is changed from 0 second to 4200 seconds. The images are output for 10 hours. The time for performing closing control of the charging shutter is set to 10 minutes when the moisture content is 15*g*, and 60 minutes when the moisture content is 13 g according to the verification experiment conducted in the present exemplary embodiment. Further, the times necessary for opening and closing the shutter are 15 seconds each, and the operation is not switched while opening or closing the shutter (e.g., switch to opening the shutter while closing the shutter). In other words, once the shutter starts to be closed, the opening operation is performed only after the end of the closing operation. At least 30 seconds thus become necessary to start the next job.

Referring to FIGS. 7A, 7B, and 7C, a thin solid line indicates the productivity when the charging shutter is closed at the same time as shifting to the low power consumption mode (a comparison example). A thick solid line indicates the productivity when the time from ending the image forming process to closing the charging shutter is set to 10 minutes, independent of shifting to the low power consumption mode. Similarly, a thin broken line indicates the productivity when the time from ending the image forming process to closing the charging shutter is set to 60 minutes, independent of shifting to the low power consumption mode.

As illustrated in FIGS. 7A, 7B, and 7C, when the charging shutter is closed every time the image forming apparatus shifts to the low power consumption mode, the productivity becomes greatly lowered as the time for shifting to the low power consumption mode becomes shorter. In contrast, when the charging shutter closing control time is set independently from the time to shift to the low power consumption mode, lowering of productivity is suppressed as the setting of the charging shutter closing control time becomes longer. It has thus been confirmed that the generation of image deletion and lowering of the productivity can be reduced by setting the charging shutter closing control time to be as long as possible without generating image deletion.

According to the present exemplary embodiment, the time from ending the print job to starting to close the charging shutter is determined according to the moisture content inside the copying machine when the print job has ended. Since insulation of the image forming apparatus according to the present exemplary embodiment is high, a change in the installation environment while the charging shutter is being closed does not greatly affect the moisture content in the apparatus. As a result, if the insulation of the image forming apparatus is low, or if there is a great change in the environment, the shutter closing time can be reset considering a transition in environment data.

A second exemplary embodiment according to the present invention will be described below. Configurations which are similar to those in the first exemplary embodiment will be assigned same reference numbers, and description will be omitted.

According to the present exemplary embodiment, the time from ending the image forming process to closing the charging shutter is set considering the moisture content and the number of sheets on which images have been formed. More specifically, when the number of sheets on which images have been formed is large, the time until closing the charging shutter is set short, and if the number of sheets is small, the time is set long.

According to the present exemplary embodiment, the time from ending the image forming process to closing the charging shutter is determined using a relationship (table) recorded in the ROM 102. Table 1 illustrates the relationship stored in the ROM.

TABLE 1

| | | Number of sheets on which images are formed | | | | |
|---|---|---|---|---|---|---|
| | | 100,000 | 200,000 | 300,000 | 400,000 | 500,000 |
| Moisture content | 15 g or more | 15 min. | 13 min. | 10 min. | 7 min. | 5 min. |
| | 13 g or more and less than 15 g | 90 min. | 78 min. | 60 min. | 42 min. | 30 min. |
| | 6 g or more and less than 13 g | 180 min. | 156 min. | 120 min. | 84 min. | 60 min. |
| | Less than 6 g | 360 min. | 312 min. | 240 min. | 168 min. | 120 min. |

The above-described table indicates a desirable relationship for reducing both the generation of image deletion and lowering of the productivity, acquired as a result of examinations using a plurality of apparatuses. However, it becomes necessary to adjust the relationship depending on individual difference of the image forming apparatus. According to the present exemplary embodiment, there is a correction mechanism (operation unit) for the user to appropriately correct the above-described relationship. The control performed from the end of the image forming process to closing the shutter using the above-described relationship will be described below with reference to a flowchart.

Since the entire control is similar to the first exemplary embodiment, description will be omitted.

Figure 8:
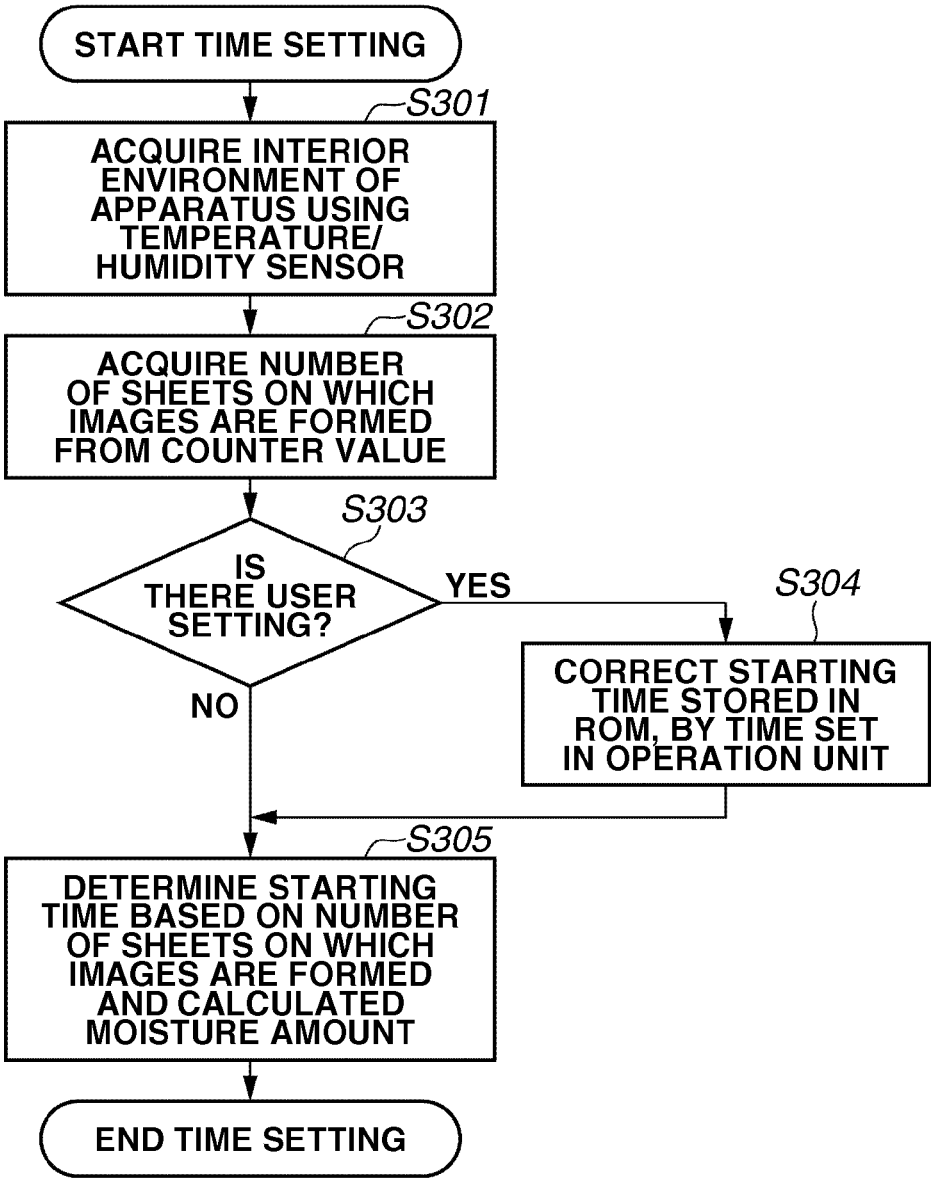
FIG. 8 is a flowchart illustrating opening and closing control of the charger shutter.

A process for setting the start time (step S101), i.e., the already defined process, will be described in detail below with reference to FIG. 8. In the process, the time until closing the shutter is changed based on the number of sheets on which images are formed and the moisture content calculated from the temperature and the humidity.

In step S301, the CPU 101 acquires the environment inside the image forming apparatus from the temperature/humidity sensor, i.e., the environment sensor, and calculates the moisture content. The CPU 101, i.e., a control unit, calculates the moisture content in the apparatus based on the result measured by the temperature/humidity sensor.

In step S302, the CPU 101 acquires an accumulated number of sheets on which images have been formed, counted by the counter 114*e*.

In step S303, the CPU 101 determines whether there is information for adjusting (correcting) the individual difference of the image forming apparatus set by the user from the operation unit. If there is such information (YES in step 303), the process proceeds to step S304. If there is no correction information (NO in step S303), the process proceeds to step S305.

The process of step S304 is performed if image deletion cannot be reduced even when the shutter is closed using the relationship previously recorded in the ROM 102, due to the difference in a generated amount of the discharge product caused by the individual difference of the image forming apparatus. In step S304, the CPU 101 corrects the relationship illustrated in table 1 by time set by the user from the operation unit.

In step S305, the CPU 101 determines the time from ending the image forming process to closing the shutter, based on the relationship recorded in the ROM 102 or corrected in step S304. The CPU 101, i.e., a determination unit, determines the start time based on the accumulated number of sheets on which images have been formed in step S301 and step S302 and the calculated moisture content, and the relationship recorded in the ROM 102.

As described above, the setting time of the timer 114*a* is changed, based on the moisture content and the number of sheets on which images have been formed. The value of the setting time with respect to the moisture content and the number of sheets on which images have been formed are an example and may be other values.

According to the above-described exemplary embodiment, if the moisture content in the copying machine is small after ending the print job and the number of sheets on which images have been formed is comparatively small, image deletion is hardly generated. The time from ending the print job to starting to close the charging shutter is thus set long. As a result, deterioration in the durability of the charging shutter and the driving device can be reduced. Further, lowering of productivity due to an operation time of restoring from the closed state to the open state after once closing the shutter can be suppressed. Furthermore, if the moisture content in the copying machine is large and the number of sheets on which images have been formed is comparatively large, image deletion is easily generated. In such a case, the time from ending the print job to starting to close the charging shutter is set short, so that image deletion can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-052018 filed Mar. 9, 2010, which is hereby incorporated by reference herein in its entirety.

What is claimed is:

1. A charging device comprising:

a corona charger having an opening;

a shutter configured to open and close the opening of the corona charger;

a humidity sensor configured to detect humidity; and a control unit configured to control an amount of time from ending an image forming process to starting to close the opening using the shutter, based on the humidity detected by the humidity sensor.

2. The charging device according to claim 1, further comprising a temperature sensor configured to detect temperature, wherein the control unit controls the amount of time from ending an image forming process to starting to close the opening using the shutter, based on the humidity detected by the humidity sensor and temperature detected by the temperature sensor when the image forming process is ended.

3. The charging device according to claim 1, wherein the time from ending an image forming process to starting to close the opening using the shutter is reduced when the humidity detected by the humidity sensor becomes higher than a predetermined level.

4. The charging device according to claim 1, wherein the control unit is configured to control the time from ending an image forming process to starting to close the opening using the shutter based on the humidity detected by the humidity sensor when the image forming process is ended.

5. The charging device according to claim 1, wherein the control unit is configured to control the time so that the time from ending an image forming process to starting to close the opening using the shutter becomes first time in a case where the humidity detected by the humidity sensor is a first value, and to control the time so that the time from ending an image forming process to starting to close the opening using the shutter becomes second time longer than the first time in a case where the humidity detected by the humidity sensor is a second value lower than the first value.

6. The charging device according to claim 1, wherein the control unit is configured to control the time so that the time from ending an image forming process to starting to close the opening using the shutter becomes third time in a case where the humidity detected by the humidity sensor is within a first range, and to control the time so that the time from ending an image forming process to starting to close the opening using the shutter becomes fourth time longer than the third time in a case where the humidity detected by the humidity sensor is within a second range lower than the first range.

7. An image forming apparatus comprising:

a photosensitive member;

a corona charger having an opening and configured to charge the photosensitive member;

an image forming unit configured to form a toner image on a surface of the photosensitive member charged by the corona charger;

a transfer unit configured to transfer the toner image formed on the surface of the photosensitive member by the image forming unit onto a recording material;

a fixing unit configured to heat and pressurize the recording material on which the toner image is transferred by the transfer unit so as to fix the toner image on the recording material;

a shutter configured to open and close the opening of the corona charger;

a humidity sensor configured to detect humidity; and a control unit configured to control an amount of time from ending an image forming process to starting to close the opening using the shutter, based on the humidity detected by the humidity sensor.

8. The image forming apparatus according to claim 7, wherein the control unit is configured to switch a first mode for supplying power to the fixing unit to a second mode for stopping supplying power to the fixing unit when a predetermined time elapses after ending an image forming process, and to perform a process to close the opening of the corona charger with the shutter regardless of the first mode or the second mode when set time from ending an image forming process to starting to close the opening using the shutter elapses.

9. The image forming apparatus according to claim 7, further comprising a temperature sensor configured to detect temperature, wherein the control unit controls the amount of time from ending an image forming process to starting to close the opening using the shutter, based on the humidity detected by the humidity sensor and temperature detected by the temperature sensor when the image forming process is ended.

10. The image forming apparatus according to claim 7, wherein the time from ending an image forming process to starting to close the opening using the shutter is reduced when the humidity detected by the humidity sensor becomes higher than a predetermined level.

11. The image forming apparatus according to claim 7, wherein the control unit is configured to control the time from ending an image forming process to starting to close the opening using the shutter based on the humidity detected by the humidity sensor when the image forming process is ended.

12. The image forming apparatus according to claim 7, wherein the control unit is configured to control the time so that the time from ending an image forming process to starting to close the opening using the shutter becomes first time in a case where the humidity detected by the humidity sensor is a first value, and to control the time so that the time from ending an image forming process to starting to close the opening using the shutter becomes second time longer than the first time in a case where the humidity detected by the humidity sensor is a second value lower than the first value.

13. The image forming apparatus according to claim 7, wherein the control unit is configured to control the time so that the time from ending an image forming process to starting to close the opening using the shutter becomes third time in a case where the humidity detected by the humidity sensor is within a first range, and to control the time so that the time from ending an image forming process to starting to close the opening using the shutter becomes fourth time longer than the third time in a case where the humidity detected by the humidity sensor is within a second range lower than the first range.

14. A charging device comprising:

a corona charger having an opening;

a shutter configured to open and close the opening of the corona charger;

a humidity sensor configured to detect humidity;

a temperature sensor configured to detect temperature; and a control unit configured to control an amount of time from ending an image forming process to starting to close the opening using the shutter, based on moisture content acquired from the temperature detected by the temperature sensor and the humidity detected by the humidity sensor.

15. The charging device according to claim 14, wherein the time from ending an image forming process to starting to close the opening using the shutter is reduced when the moisture content acquired from the temperature detected by the temperature sensor and the humidity detected by the humidity sensor becomes higher than a predetermined level.

16. The charging device according to claim 14, wherein the control unit is configured to control the time from ending an image forming process to starting to close the opening using the shutter based on the moisture content when the image forming process is ended acquired from the temperature detected by the temperature sensor when the image forming process is ended and the humidity detected by the humidity sensor when the image forming process is ended.

17. The charging device according to claim 14, wherein the control unit is configured to control the time so that the time from ending an image forming process to starting to close the opening using the shutter becomes first time in a case where the moisture content is a first value, and to control the time so that the time from ending an image forming process to starting to close the opening using the shutter becomes second time longer than the first time in a case where moisture content is a second value lower than the first value.

18. The charging device according to claim 14, wherein the control unit is configured to control the time so that the time from ending an image forming process to starting to close the opening using the shutter becomes third time in a case where the moisture content is within a first range, and to control the time so that the time from ending an image forming process to starting to close the opening using the shutter becomes fourth time longer than the third time in a case where the moisture content is within a second range lower than the first range.

19. An image forming apparatus comprising:

a photosensitive member;

a corona charger having an opening and configured to charge the photosensitive member;

an image forming unit configured to form a toner image on a surface of the photosensitive member charged by the corona charger;

a transfer unit configured to transfer the toner image formed on the surface of the photosensitive member by the image forming unit onto a recording material;

a fixing unit configured to heat and pressurize the recording material on which the toner image is transferred by the transfer unit so as to fix the toner image on the recording material;

a shutter configured to open and close the opening of the corona charger;

a humidity sensor configured to detect humidity;

a temperature sensor configured to detect temperature; and a control unit configured to control an amount of time from ending an image forming process to starting to close the opening using the shutter, based on moisture content acquired from the temperature detected by the temperature sensor and the humidity detected by the humidity sensor.

20. The image forming apparatus according to claim 19, wherein the control unit is configured to switch a first mode for supplying power to the fixing unit to a second mode for stopping supplying power to the fixing unit when a predetermined time elapses after ending an image forming process, and to perform a process to close the opening of the corona charger with the shutter regardless of the first mode or the second mode when set time from ending an image forming process to starting to close the opening using the shutter elapses.

21. The image forming apparatus according to claim 19, wherein the time from ending an image forming process to starting to close the opening using the shutter is reduced when the moisture content acquired from the temperature detected by the temperature sensor and the humidity detected by the humidity sensor becomes higher than a predetermined level.

22. The image forming apparatus according to claim 19, wherein the control unit is configured to control the time from ending an image forming process to starting to close the opening using the shutter based on the moisture content when the image forming process is ended acquired from the temperature detected by the temperature sensor when the image forming process is ended and the humidity detected by the humidity sensor when the image forming process is ended.

23. The image forming apparatus according to claim 19, wherein the control unit is configured to control the time so that the time from ending an image forming process to starting to close the opening using the shutter becomes first time in a case where the moisture content is a first value, and to control the time so that the time from ending an image forming process to starting to close the opening using the shutter becomes second time longer than the first time in a case where moisture content is a second value lower than the first value.

24. The image forming apparatus according to claim 19, wherein the control unit is configured to control the time so that the time from ending an image forming process to starting to close the opening using the shutter becomes third time in a case where the moisture content is within a first range, and to control the time so that the time from ending an image forming process to starting to close the opening using the shutter becomes fourth time longer than the third time in a case where the moisture content is within a second range lower than the first range.

* * * * *